US009140434B2

(12) United States Patent
Pan

(10) Patent No.: US 9,140,434 B2
(45) Date of Patent: Sep. 22, 2015

(54) STRUCTURE COMBINING SOFT CORE WITH SOFT HEAD FOR LED CHRISTMAS LIGHT WITH FOUR CONNECTION PINS

(71) Applicant: Kuo-Wei Pan, Hsinchu (TW)

(72) Inventor: Kuo-Wei Pan, Hsinchu (TW)

( * ) Notice: Subject to any disclaimer, the term of this patent is extended or adjusted under 35 U.S.C. 154(b) by 0 days.

(21) Appl. No.: 14/161,703

(22) Filed: Jan. 23, 2014

(65) Prior Publication Data

US 2015/0204524 A1 Jul. 23, 2015

(51) Int. Cl.

| | |
|---|---|
| ***F21S 4/00*** | (2006.01) |
| ***F21V 21/00*** | (2006.01) |
| ***F21V 19/00*** | (2006.01) |
| ***F21V 23/06*** | (2006.01) |
| *F21Y 101/02* | (2006.01) |
| *F21W 121/00* | (2006.01) |

(52) U.S. Cl.

CPC ..... *F21V 19/0025* (2013.01); *F21V 23/06* (2013.01); *F21W 2121/00* (2013.01); *F21Y 2101/02* (2013.01)

(58) Field of Classification Search

CPC ..... F21V 21/002; F21V 21/00; H01R 33/06; H01R 13/64

USPC ..... 313/318.01, 318.12, 498; 362/249.16, 362/654, 391, 382, 123, 310, 653, 659

See application file for complete search history.

(56) References Cited

U.S. PATENT DOCUMENTS

| | | | | |
|---|---|---|---|---|
| 5,672,000 | A * | 9/1997 | Lin | 362/249.06 |
| 6,109,764 | A * | 8/2000 | Shu | 362/653 |
| 6,452,317 | B1 * | 9/2002 | Tseng | 313/318.01 |
| 6,609,814 | B2 * | 8/2003 | Ahroni | 362/249.12 |
| 8,172,427 | B2 * | 5/2012 | Hsu | 362/249.16 |
| 2005/0082965 | A1 * | 4/2005 | Huang et al. | 313/498 |
| 2011/0050081 | A1 * | 3/2011 | Lin | 313/318.01 |
| 2014/0268689 | A1 * | 9/2014 | Chen | 362/123 |
| 2014/0355275 | A1 * | 12/2014 | Tseng | 362/382 |
| 2014/0355277 | A1 * | 12/2014 | Lin | 362/391 |

* cited by examiner

*Primary Examiner* — Thomas A Hollweg
*Assistant Examiner* — Kevin Quarterman
(74) *Attorney, Agent, or Firm* — Leong C. Lei

(57) ABSTRACT

The present invention proposes a LED Christmas light, using an LED bulb with four connection pins to insert in a soft core configured with four slots allowing the four connection pins to be passed through and bended configured on the bottom thereof, and the soft core being inserted in a soft head with four V-typed convex plates in pairs face-to-face and extended to the bottom face thereof configured on the inside thereof, where an engagement partitionment groove is formed between each two adjacent convex plates in the soft head, allowing four metal conducting sheets with a conducting wire to be respectively engaged therewith, thereby allowing one LED Christmas light unit to use an LED bulb with a light source of more than four colors.

2 Claims, 3 Drawing Sheets

STRUCTURE COMBINING SOFT CORE WITH SOFT HEAD FOR LED CHRISTMAS LIGHT WITH FOUR CONNECTION PINS

TECHNICAL FIELD OF THE INVENTION

The present invention relates to an LED Christmas light structure, and more particularly to a Christmas light unit structure in a Christmas light string.

DESCRIPTION OF THE PRIOR ART

An LED decoration light structure, as FIG. 1 shows, is constituted by components such as a LED bulb (10), soft core (20) and soft head (30). Conventionally, a general LED bulb (10) have two pins respectively coupled to the soft core (20), and two metal conducting sheets (51) with a conducting white (50) are respectively configured on two inner sides of the soft head (30), allowing the two pins of the LED bulb (10) to be respectively in conducting contact with the two metal conducting sheets (51) when the soft core (20) connected with the LED bulb (10) is inserted in the soft head (30), thereby combining a plurality of LED decoration light units into an entire Christmas light string.

Because luminous bodies of the current LED bulbs (10) have been developed to multi-color sources having more than three colors, it enables the LED bulbs (10) to perform a more diversified color change. But, the LED bulb (10) with two pins of the current Christmas light only can have a luminous body of three colors at most, incapable of upgrading the color change of a Christmas light and conforming to requirements.

SUMMARY OF THE INVENTION

Thus, the main object of the present invention is to provide an LED Christmas light with four connection pins, using an LED bulb with four connection pins to insert in a soft core configured with four slots for the four connection pins to be passed through and bended configured on the bottom thereof, and the soft core inserted in a soft head with four V-typed convex plates in pairs face-to-face and extended to the bottom face thereof configured on the inside thereof, where an engagement partitionment groove is formed between each two adjacent convex plates in the soft head, allowing four metal conducting sheets with a conducting wire to be respectively engaged therewith, thereby allowing one LED Christmas light unit to use an LED bulb with a light source of more than four colors, and the LED Christmas light to be more colorful and variable.

DETAILED DESCRIPTION OF THE PREFERRED EMBODIMENTS

Figure 1:
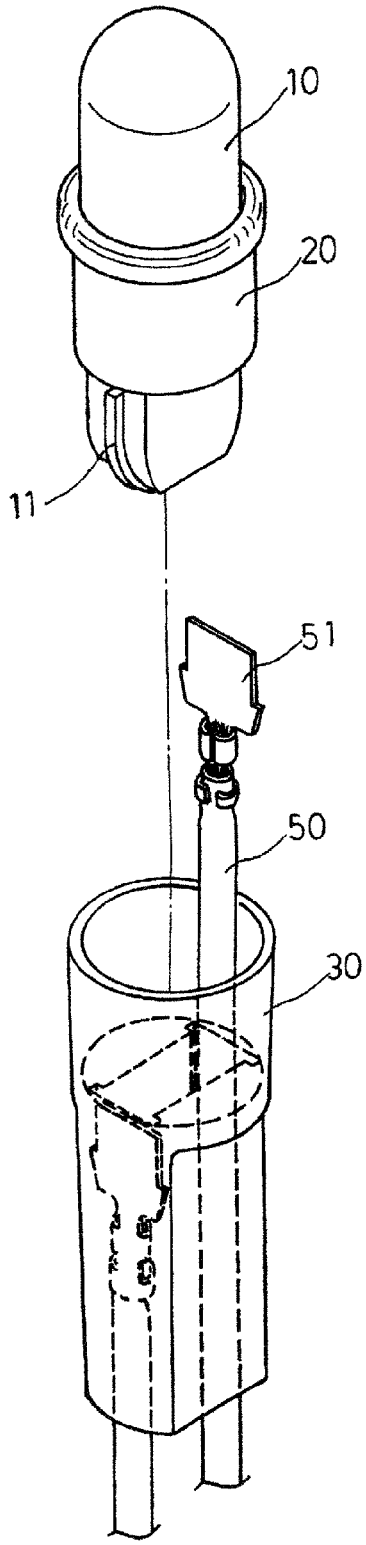
PRIOR ART FIG.1
FIG. 1 is a perspective view of a conventional LED Christmas light structure with two connection pins.
Figure 2:
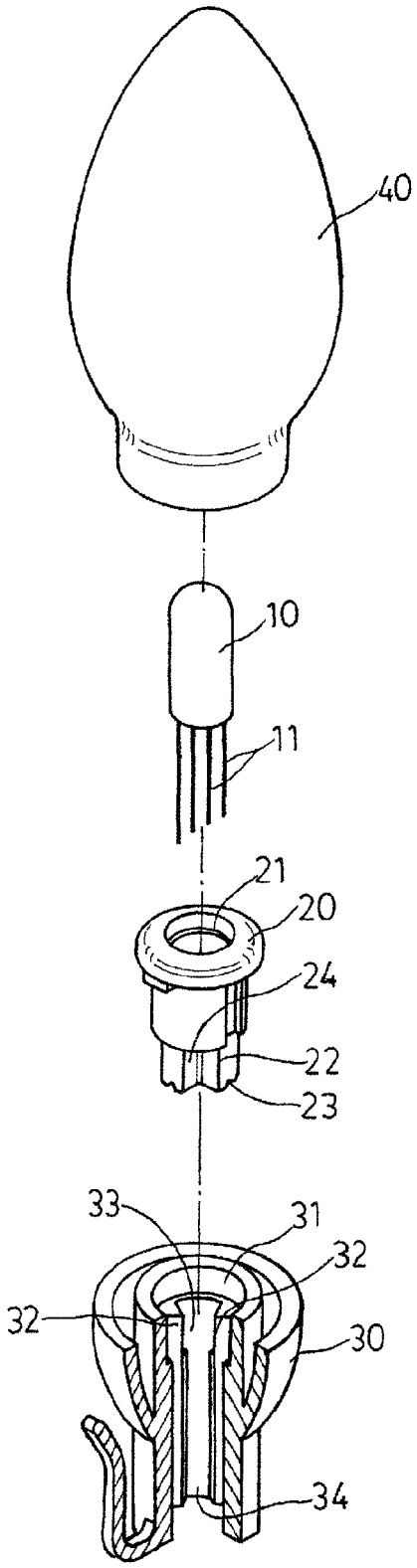
FIGS. 2 and 3 are exploded views of a structure of the present invention.
Figure 3:
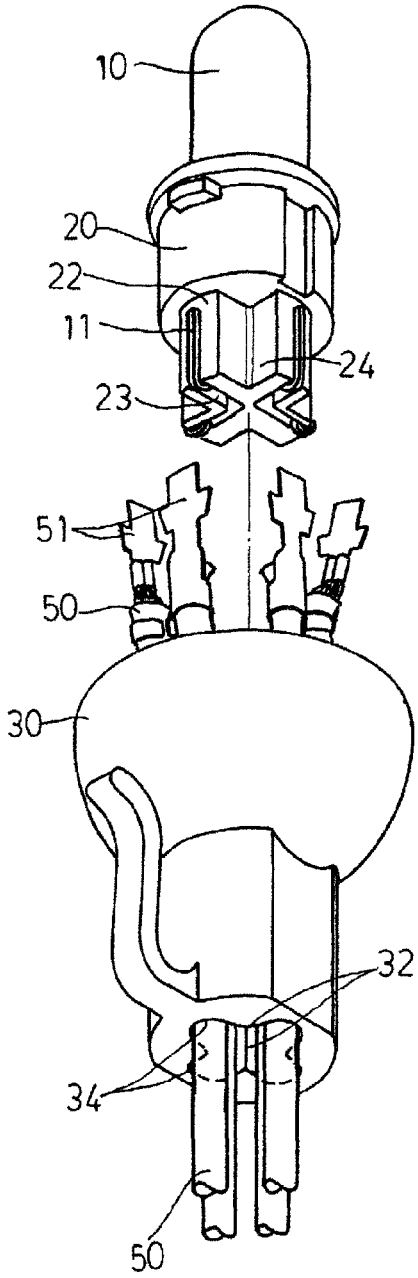

Referring to FIGS. 2 and 3, an LED Christmas light with four connection pins of the present invention mainly includes an LED bulb (10), soft core (20), soft head (30) and lamp shell (40), where the LED bulb (10) is configured with four connection pins (11) arranged in a single row on the bottom thereof, and the soft core (20) is configured with an opening formed into an accepting groove (21) on the top thereof, and the bottom thereof is formed into a base (22), four corners of which are respectively formed into a V-typed partitionment groove (24). In addition, four slots (23) are configured on the bottom face of the base (22). Furthermore, the soft head (30) also has an opening formed into an accepting groove (31) on the top thereof, and four V-typed convex plates (32) in pairs face-to-face and extended to the bottom face of the soft head (30) are configured in the accepting groove (31). Furthermore, an engagement partitionment groove (33) is formed at one upper half of a space between each two adjacent V-typed convex plates (32), and a conducting wire groove (34) is configured below the engagement partitionment groove (33).

Figure 4:
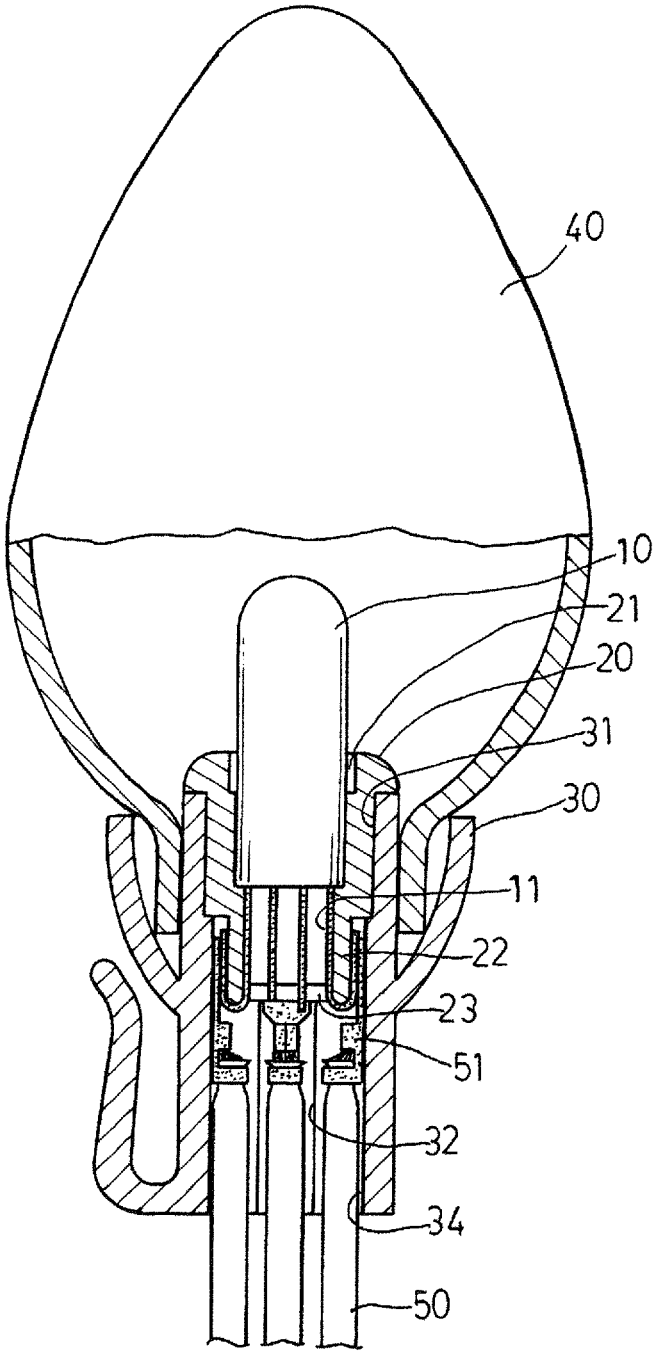
FIG. 4 is a cross-sectional view of the present invention after assembly.

Referring to FIGS. 2 to 4, the LED bulb (10) is inserted in the accepting groove (21) of the soft core (20), and the four connection pins (11) are respectively passed through the four slots (23), and moved toward four sides of the base (22) along the respective partitionment grooves (24) and bended to attach to the faces at the four side of the base (22). In addition, four metal conducting sheets (51) with a conducting wire (50) are respectively engaged with the four engagement partitionment grooves (33) via the conducting wire groove (34) at the bottom of the soft head (30). Thereafter, the soft core (20) assembled with the LED bulb (10) is inserted in the accepting groove (31) of the soft head (30); the connection pins (11) on the four side faces of the base (22) respectively are in conducting contact with the four metal conducting sheets (51) on the engagement partitionment grooves (33) of the soft head (30). Meanwhile, the four V-typed partitionment grooves (24) on the base (22) are respectively attached closely to the four V-typed convex plates (32) closely to isolate the four conducting wires (50) together with the four metal conducting sheets (51) from one another completely. Finally, the lamp shell (40) is inserted in the soft head (30) to cover the LED light bulb (10), thereby allowing one LED Christmas light unit to use an LED bulb with a light source of more than four colors, and the LED Christmas light to be more colorful and variable.

I claim:

1. A structure combining a soft core with a soft head for an LED Christmas light with four connection pins, comprising an LED bulb, a flexible core, a flexible head and a lamp shell, said LED bulb having four connection pins arranged in a single row, said core being configured with an accepting groove allowing said LED bulb to be inserted therein, and a bottom portion of said core being formed into a base, which has a bottom surface that is substantially flat with four slots formed therein and in communication with the accepting groove of the core so as to allow said four connection pins of said LED bulb to be passed through to respectively bend and attach to four side faces of said base, said head being also configured with an accepting groove for said core to be inserted in, said accepting groove of said head being configured with four convex plates in pairs face-to-face on an inner edge thereof and extended to a bottom face of said head, an engagement partitionment groove being formed on an upper half of a place between each two adjacent ones of said convex plates a conducting wire groove being configured below the engagement partitionment groove, four metal conducting sheets with a conducting wire being respectively received and retained in said four engagement partitionment grooves with the conducting wires of the metal conducting sheets being received and retained in the conducting wire grooves, said lamp shell being inserted in said head to cover said LED bulb.

2. The structure according to claim 1, wherein a partitionment groove is formed in each of four sides of said base of said core to correspond to each of said convex plates, said partitionment grooves being shaped and arranged to respectively receive and closely mate said four convex plates of said head so as to isolate said four conducting wires together with said four metal conducting sheets completely from one another.

* * * * *